US009586652B2

(12) United States Patent
Harrison

(10) Patent No.: US 9,586,652 B2
(45) Date of Patent: Mar. 7, 2017

(54) ANTI-PIRACY DEVICE FOR SHIPS

(71) Applicant: Easi-Chock Ltd., Bolton (GB)

(72) Inventor: Wayne Harrison, Cheshire (GB)

(73) Assignee: Easi-Chook LTD, Bolton (GB)

( * ) Notice: Subject to any disclaimer, the term of this patent is extended or adjusted under 35 U.S.C. 154(b) by 0 days.

(21) Appl. No.: 14/751,635

(22) Filed: Jun. 26, 2015

(65) Prior Publication Data

US 2016/0375961 A1 Dec. 29, 2016

(51) Int. Cl.

*B63B 17/00* (2006.01)
*B63B 19/00* (2006.01)
*B63B 9/00* (2006.01)

(52) U.S. Cl.

CPC ..... *B63B 17/00* (2013.01); *B63B 9/00* (2013.01); *B63B 19/00* (2013.01); *B63B 2017/0045* (2013.01)

(58) Field of Classification Search

CPC ..... B63B 17/00; B63B 9/00; B63B 19/00
USPC ..... 114/203, 174–178, 361, 228
See application file for complete search history.

(56) References Cited

U.S. PATENT DOCUMENTS 1,364,695 A * 1/1921 Boyan ..... B63B 19/00 114/177
2,178,392 A * 10/1939 Elfstrom ..... B63B 19/00 114/178
4,095,640 A * 6/1978 Beckerer, Jr. ..... E06B 7/2309 114/178
4,295,675 A * 10/1981 Niskin ..... B63B 19/02 114/177
6,158,372 A * 12/2000 Erskine ..... B63B 19/00 114/177
7,451,717 B1 * 11/2008 Levine ..... B63B 9/00 114/174
8,596,697 B1 * 12/2013 Haibel ..... F16J 13/12 220/298

* cited by examiner

*Primary Examiner* — Lars A Olson
*Assistant Examiner* — Jovon Hayes
(74) *Attorney, Agent, or Firm* — Tarolli, Sundheim, Covell & Tummino LLP

(57) ABSTRACT

An anti-piracy device for ships comprises a blocking device, such as a metal plate, to block an opening from the exterior to the interior of a ship, such as a window or porthole. The anti-piracy device also includes mounts, which are mounted permanently to the interior wall of the ship, to which the blocking device can be removably fastened, by nuts or the like. This allows the device to be installed when entering dangerous waters, but removed and stored when traversing safe waters.

21 Claims, 9 Drawing Sheets

ANTI-PIRACY DEVICE FOR SHIPS

TECHNICAL FIELD OF THE INVENTION

The present invention relates to an anti-piracy device for ships, a method of installing such an anti-piracy device and a kit of parts for installing an anti-piracy device.

BACKGROUND TO THE INVENTION

Piracy on ships is an ongoing problem, costing lives as well as financial losses. Piracy tends to be concentrated in certain areas, with particular recent emphasis on the waters around Somalia. Numerous weapons are available which are intended to prevent pirates from boarding ships, for example, long range acoustic devices, anti-piracy lasers, water cannon, electric fences, nets, foam, hoses and so on. However, some of these devices are costly, or require supervision and in any event, pirates are still able to board ships, even those provided with armed security guards.

In the event of boarding by pirates, one response is for the crew, and any security guards if present, to retreat to a safe room (or "citadel") and radio for (often military) assistance, in order to avoid being taken hostage by pirates. One object of the present invention is to provide an anti-piracy device capable of improving the chances of reaching a citadel once pirates have boarded a ship.

Crew members spend much time on ships, and often can spend relatively long periods of time operating and trading in dangerous waters and a relatively long time in safer waters. Therefore, in order to feel at home on the ship, it is preferable that it has the ambiance of a home or workplace, when possible, rather than that of a prison or barracks. Accordingly, another object of the present invention is to provide an anti-piracy device capable of being installed when entering dangerous waters, but removed and stored at other times.

SUMMARY OF THE INVENTION

According to a first aspect of the invention, there is provided an anti-piracy device comprising a blocking device, for closing a space behind an opening to the interior of the ship, a plurality of mounts for permanent attachment to the interior of a ship adjacent the opening, and a plurality of fasteners for removably attaching the blocking device to the mounts.

The mounts and the fastener may be provided with screw threads, so that the fastener can be unscrewed to remove the blocking device when in safe waters.

The mounts may be adhered to the interior of the ship. Counterintuitively, adhering the mounts with a suitable adhesive, such as methyl methacrylate (e.g. MA310 from ITW Plexus), can provide a strong enough bond to adequately hold the blocking device in place well enough to at least slow down the ingress of pirates through the opening.

The mounts may have a plate with apertures therein, from which a threaded rod extends, whereby adhesive applied to the surface of the interior of the ship is forced through the apertures when the mounts are pushed towards the surface, thereby adhering the surface-facing face of the plate to the wall and forming rivet-like heads on the rod side. These mounts are easy to fit, with no welding, no hot works and hence no requirement for dry-docking the ship.

At least one stand-off bracket may be mounted to the mounts, and the blocking device may be mounted to the mounts via the stand-off bracket. A stand-off bracket brings the point of mounting further towards the interior of the room, thereby avoiding furniture associated with the opening (e.g. the frame of a porthole).

The stand-off bracket may be formed of U-shaped material, having two parallel plates connected by a web. One parallel plate may be connected to the interior wall of the ship via the mount, whilst the other may be connected to the blocking device.

The stand-off bracket may also be formed of somewhat Z-shaped material, consisting of a parallel plate connected by a web.

The stand-off bracket may be permanently mounted to one of the mount or the blocking device. The stand-off bracket may be removably mounted to the mount and/or the blocking device. The stand-off bracket may be removably mounted to the mounts via nuts and may comprise nuts/bolts to mate with to corresponding nuts/bolts to removably attach the blocking device, or manufactured as part of the blocking device, e.g. integral with a frame.

One or more anti-tamper brackets may be provided between the fastener and the blocking device. An anti-tamper bracket may be formed of L-shaped, or U-shaped material, having one web that in use is parallel to the plane of the interior wall of the ship and a plate (or two plates if U-shaped) that is perpendicular to the wall to make it more difficult to reach the fastener from outside.

The opening may be a window or porthole, having a pane of glass, or the like, therein. The blocking device may be a solid plate, which extends entirely across the opening, or a grille, having a frame for mounting to the mounts and bars extending from the frame. Alternatively, the blocking device may comprise a plate having apertures therein so as to forma grid pattern. The bars may form a grid/mesh or may extend from top to bottom. A solid plate prevents pirates from seeing into the ship, thus additionally disorienting them. A grille, on the other hand, allows the crew to see out, thus making it more likely that the device will be used in practice.

The frame may have a plurality of apertures therein to receive threaded rods of the mount.

There may be at least 2 mounts, e.g. at least 4 mounts, such as 6 mounts, and a corresponding number of apertures in the blocking device and fasteners for removably attaching the blocking device to the mounts.

Whilst bars over windows are not in themselves novel, having been used, for example in prisons, they are deliberately permanently installed, to prevent inmates escaping, or intruders entering. Moreover, they are often placed on the outside of buildings, in order to allow easy opening of the windows, in contrast to the present invention which is provided on the interior. Providing the anti-piracy devices on the interior is necessary because, being removable, it is important that it is only removable from within (i.e. by the crew), not from outside (by pirates). Providing them on the interior is also useful in avoiding the devices being used as an aid to climbing the walls of the ship.

A second aspect of the invention provides a ship having an interior and an exterior, with an opening from the exterior to the interior and at least one mount provided adjacent the opening, wherein, in use, an anti-piracy blocking device is removably attached to the at least one mount to prevent or slow down access to the interior of the ship through the opening.

The ship of the second aspect of the invention may include any of the aspects of the anti-piracy device of the first aspect of the invention.

A third aspect of the invention provides a method of adapting a ship for improving the likely outcome in the event of pirate attack, the method comprising fixing mounts to an interior wall of the ship adjacent an opening and providing a blocking device and fasteners, whereby the blocking device can be removably fastened to the mounts.

The mounts may comprise plates having apertures therein and threaded rods extending from the plates, and the mounts may be are attached to the interior wall by adhesive, by pushing the plate of the mount into the adhesive such that it extends through the apertures in the plate and forms heads to the interior of the plate.

The method may comprise using a jig to identify where to adhere the mounts and marking up the interior wall accordingly. The method may comprise removing paint from the interior wall to provide a clean surface for the adhesive and may comprise priming the surface. The jig may be provided with adjustable feet to adjust its position The method may comprise providing magnets on one side of the jig to locate it on the interior wall of the ship and space the jig from the wall.

The method may comprise fitting the mounts to the jig and fastening them thereto to provide a suitable gap (e.g. 2 mm) between the mounts and the interior wall, when the magnets are flush with the wall, then providing adhesive on the plate (to e.g. a height of 10-15 mm), then returning the jig to its position on the interior wall and pushing the mounts against the wall to adhere them to the wall in position.

In this description the expression "removably" is used to indicate that something may be readily attached and detached without breaking any part of the device, such that the removable part may be simply attached and detached from a ship over the course of a sea-crossing. Thus, nuts and bolts, screws and so forth, for example, allow removable attachment, whereas adhesive, welding and the like, provides a permanent attachment.

A fourth aspect of the invention is a method of securing a ship against pirate attack, the method comprising removably attaching an anti-piracy blocking device to mounts adjacent to an opening to an interior of the ship prior to entry into dangerous waters and removing the device from the mounts once safe waters are entered.

The anti-piracy device may include any of the features mentioned in relation to the first aspect of the invention.

BRIEF DESCRIPTION OF THE DRAWINGS

In order that the invention may be more clearly understood embodiments thereof will now be described, by way of example only, with reference to the accompanying drawings, of which.

DETAILED DESCRIPTION OF THE INVENTION

Figure 1:
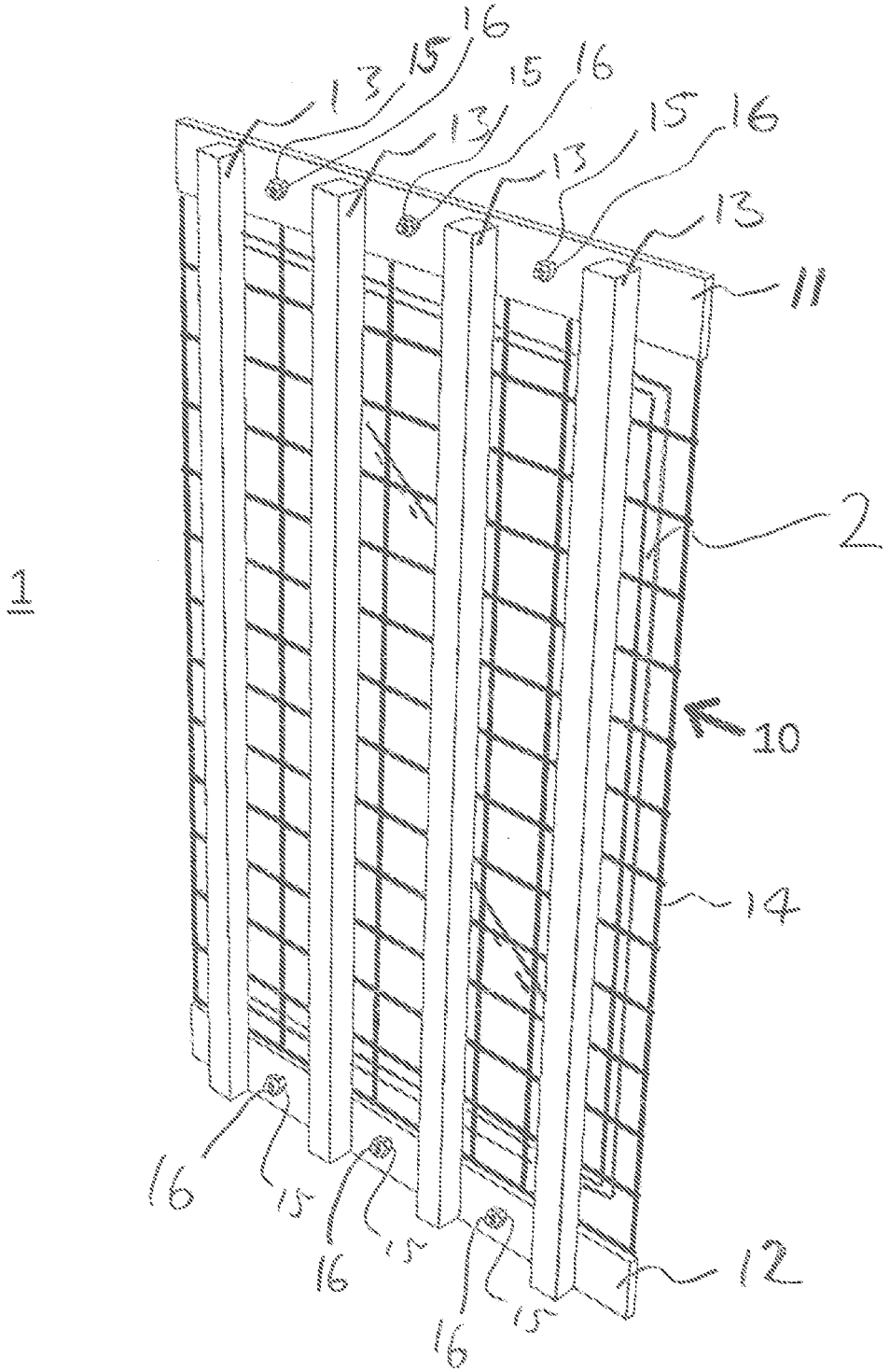
FIG. 1 shows a perspective view of a blocking device according to a first aspect of the invention installed on the interior wall of a ship.

With reference to FIG. 1, a first embodiment of a blocking device 10 which forms the main part of an anti-piracy device of a first embodiment of the invention is shown installed on the interior wall 1 of a ship. An opening in the form of a glazed window 2 can be seen behind the blocking device 10.

The blocking device of this embodiment consists of a frame formed by an upper laterally extending frame member 11 and a lower laterally extending frame member 12 each preferably formed of metal, e.g. steel plate of e.g. 5 mm thickness and 50 mm height. The frame members are sized according to the aperture that they are intended to cover, such that in this instance, the lower frame member 12 is approximately one inch below the bottom of the window 2, whilst the upper frame member 11 is approximately one inch above the top of the window. The frame members 11, 12 are each sufficiently wide to extend about 1 inch beyond the sides of the window 2.

Between the frame members 11, 12, a plurality of, in this case four, parallel bars 13 extend, each preferably formed from box section steel. These bars are welded to the frame members 11, 12. Also welded to the frame members 11, 12 and to the bars 13 is a 50 mm×50 mm steel mesh 14, which forms a grid, such that the blocking device 10 has the form of a grille. The bars 14 are so spaced as to prevent a pirate, having broken the window 2 from gaining entry through the opening, whereas the mesh is so sized as to prevent a pirate's hands from passing through the blocking device 10 to remove it from the wall and restrict the size of tools that can be passed through the grille.

The blocking device 10 is removably secured to the interior wall 1 of the ship by means of fasteners, in this case in the form of a plurality of nuts 15, in this case six nuts 15, removably screwed onto threaded rods 18 of a plurality of mounts 16, in this case six mounts 16, which extend through corresponding apertures (not shown) in the upper frame member 11 and lower frame member 12 and make up further components of the anti-piracy device. In this example three holes are provided in each frame member, each located equidistant between two bars 13 and about halfway between the top and the bottom of the respective frame member 11, 12. The nuts may be, for example, M10 A4 stainless steel hex nuts and washers (not shown) may be provided between the bolts 15 and the blocking device 10. Of course those skilled in the art may envisage alternative positions and alternative numbers of mounts.

Figure 2:
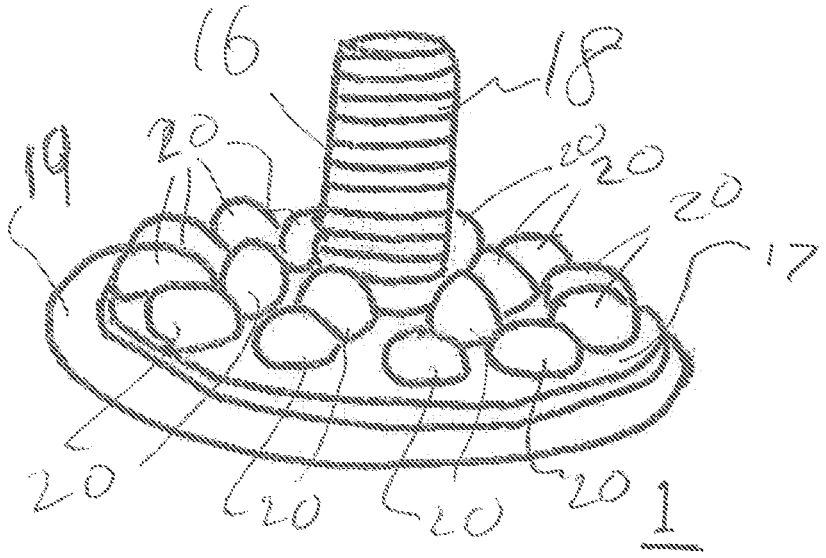
FIG. 2 shows a perspective view of a mount attached to the interior wall of a ship, upon which the blocking device of FIG. 1 may be mounted.

As shown in FIG. 2, each mount 16 comprises a circular plate 17 of for example 38 mm in diameter with a threaded rod 18 extending therefrom, as are available from bigHead Bonding Fasteners Limited in 316 stainless steel under product number 316 M1/B38-M10×30 mm. Those skilled in the art will be capable of envisaging alternative equivalents. The mounts are attached to the interior wall 1 of the ship by adhesive 19, which forms a bed of at least 2 mm between the interior wall 1 and the plate 17 and extends through apertures (not shown) in the plate 17 to form rivet-like heads 20. The adhesive 19 is preferably methyl methacrylate, such as MA310 from ITW Plexus, again those skilled in the art may find equivalent adhesives that are equally suitable for forming a strong bond between the mounts 16 and the (usually metal) interior walls 1 of ships.

Figure 3:
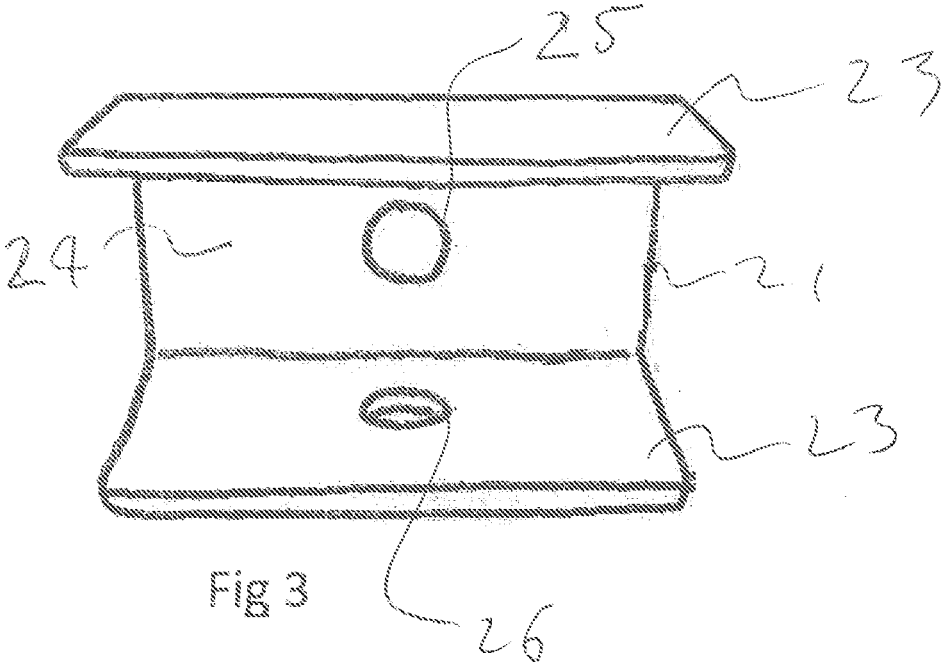
FIG. 3 shows a perspective view of an anti-tamper bracket for use with the blocking device of FIG. 1.

FIG. 3 shows an optional anti-tamper bracket 21. The anti-tamper bracket 21 is formed from steel plate of e.g. 3 mm-5 mm thickness, such as 3 mm and folded into a U-shaped cross section, having two parallel plate sections 23, and a web 24 therebetween. In a suitable embodiment, the anti-tamper bracket is 50 mm wide, with the web 24 having a height of 50 mm and the parallel plates 23 having a depth of 50 mm. An aperture 25 is provided in the centre of the web 24, such that in use, once the apertures of the blocking device 10 have been located over the rods 16 of corresponding mounts, the central rods 16 of each of the upper and lower frame members 11, 12 can be inserted through the aperture 25 of a respective anti-tamper bracket 21, such that the web 24 abuts the respective frame member 11, 12 and the nuts 15 can be attached to the threaded rods 16, to hold the anti-tamper bracket in place. In use, the anti-tamper bracket makes it even more difficult for a pirate to grab the nut 15 with a tool. A further aperture 26 is provided in one of the parallel plates 23, which could allow for the bracket to be used in an alternative orientation, with the rod extending through the further aperture, such that the nut 15 can only be accessed from below the bottom of the blocking device 10, or above the top of the blocking device 10. A further optional bracket is shown attached to the blocking device of FIG. 1, in FIG. 4. This is a stand-off bracket 27, which is similarly provided from (e.g. 3 mm thick) stainless steel folded into a U-shape. The stand-off bracket is intended to hold the grille away from any window-frames or other door-furniture, so, whilst two parallel plates 28 and 29 which are attached to the mounts 16 and the frame members 11, 12 may be of uniform height, e.g. 50 mm, the web 30 that connects them is sized according to the relevant window frame etc, and may be from 30 mm to 110 mm deep, for example. The plate of the stand-off bracket that is intended to be mounted to the mounts 16 is provided with three apertures 31 through with mounts extend, in use, whereas the opposite plate 29, is provided both with apertures (not shown), through which fastenings, such as nuts and bolts 32 attach the stand-off plate to the respective frame member 11, 12 and larger openings, which correspond with larger openings formed in the frame member 11, 12, through which a tool can extend, in order to removably attach nuts (not shown in FIG. 4) to the mounts (not shown in FIG. 4).

Figure 5:
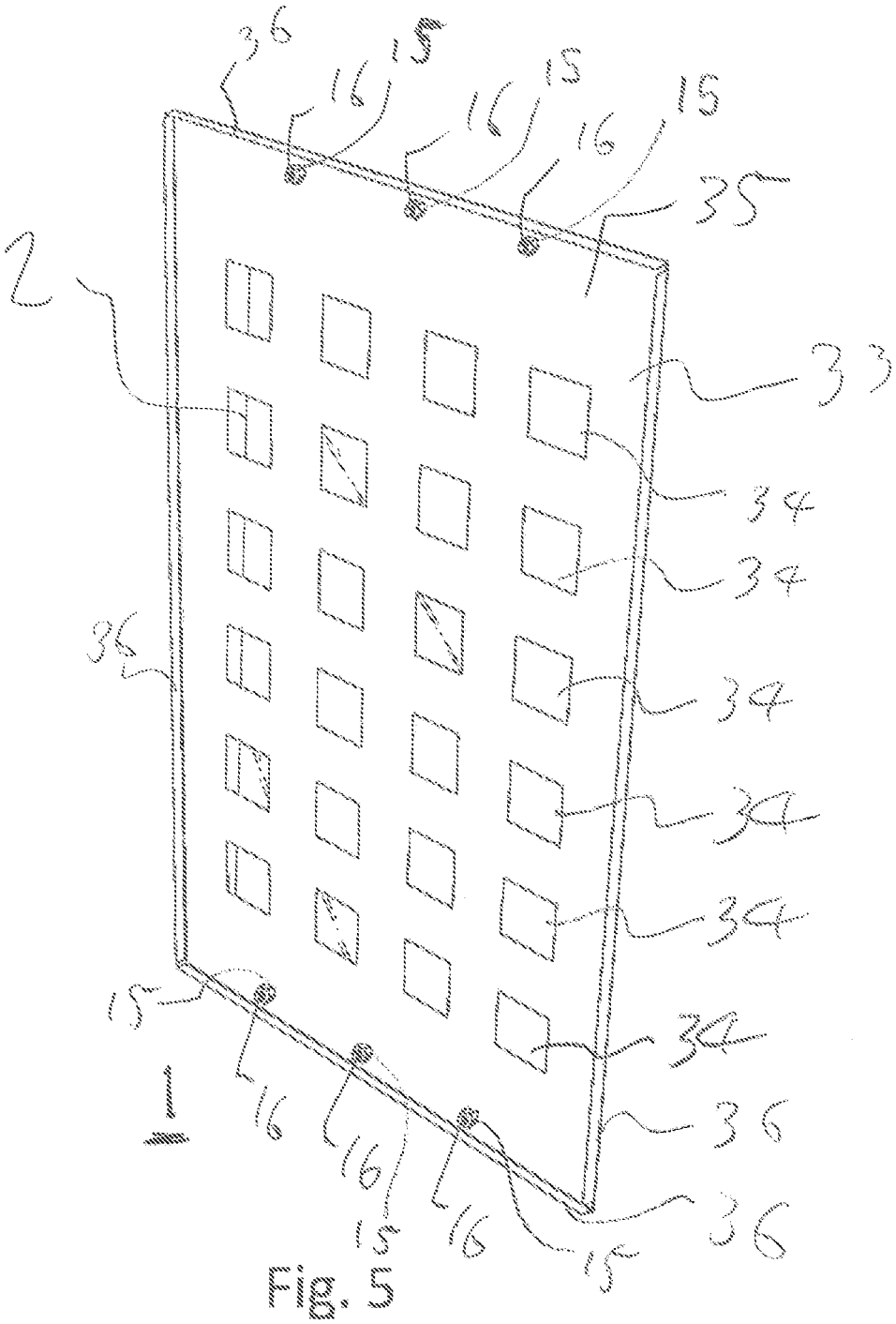
FIG. 5 shows a perspective view of blocking device according to a second embodiment of the invention.

FIG. 5 shows a blocking device 33 according to a second embodiment of the invention. This blocking device 33 is formed from a single sheet of e.g. 3 mm thick stainless steel, which forms a flat plate 35 having a rectangular shape which entirely covers the window 2 of the ship. Apertures 34 are punched in the plate 35 to allow light to pass into the interior of the ship, even when the blocking device is fitted, and the device is provided with further mounting apertures (not shown), in this embodiment, three at the top and three at the bottom, which enable removable mounting on six mounts 16 by way of six corresponding nuts IS. The four edges of the blocking device 33 are folded inward perpendicular to the plate 35 form sides 36, this increases rigidity and strength and makes it easier to pick up and manipulate the blocking device 33.

Figure 6:
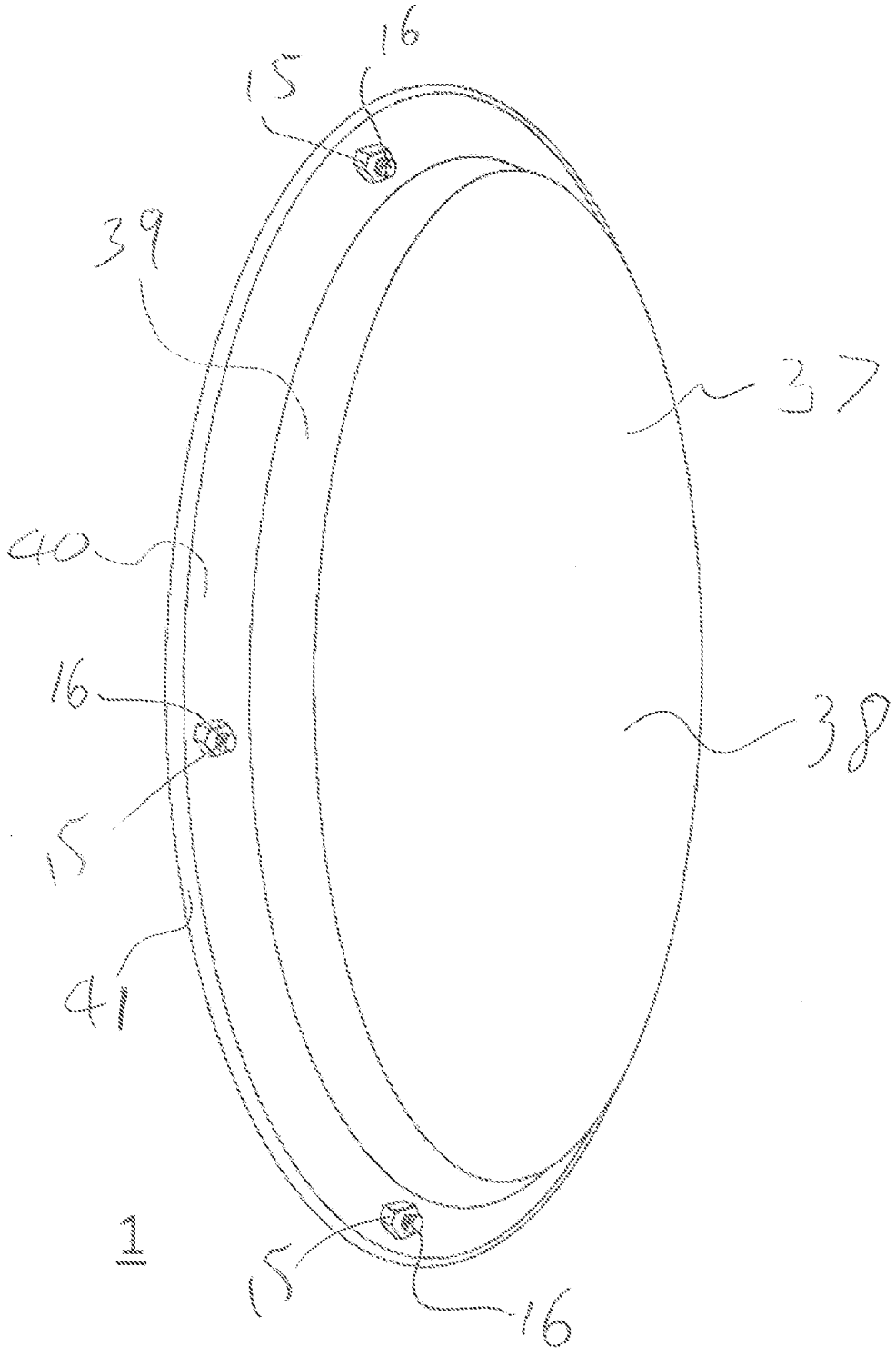
FIG. 6 shows a perspective view of a blocking device of a third embodiment of the invention.

FIG. 6 shows a blocking device 37 according to a third embodiment of the invention installed on an interior wall 1 of a ship, which may in this example be a door separating the interior from the exterior and having a circular porthole (not shown) therein.

Similarly to the blocking device 33 of the second embodiment, the blocking device 37 of the third embodiment, for blocking circular portholes is formed from a single sheet of material, e.g. 3-5 mm thick stainless steel sheet. The blocking device 37 is formed by pressing a circular sheet of steel against a cylindrical die, which is coaxial with the centre of the sheet of steel, so as to form a central circular region 38, a shoulder 39 extending out of the plane of the circular region 38, and a flange 40, extending from the shoulder 39, parallel to the central circular region 38. A lip 41 is formed at the periphery of the flange 40.

A plurality of apertures (not shown) are provided in the flange 40, in this embodiment six apertures, through which, in use, the threaded rods of six mounts 16 extend, such that the porthole blocking device 37 can be removably attached to the mounts 16 by corresponding removable fasteners, in the form of hex-nuts 15.

The mounts 16, of course, are adhered to the interior wall 1 of the ship adjacent the porthole, in the same way as described above with reference to FIG. 2.

Figure 9:
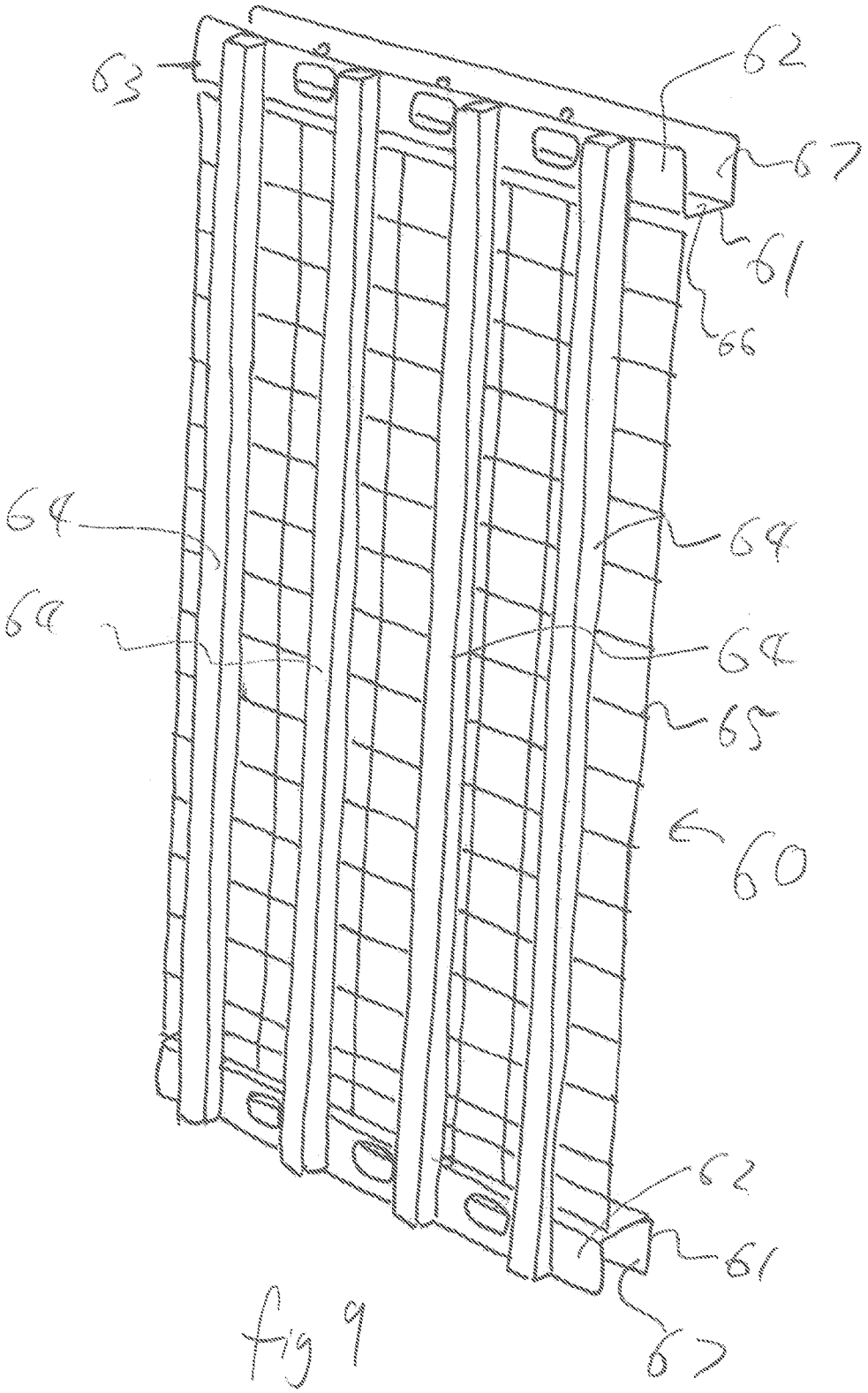
FIG. 9 shows a perspective view of a blocking device of a fourth embodiment of the invention.
Figure 10:
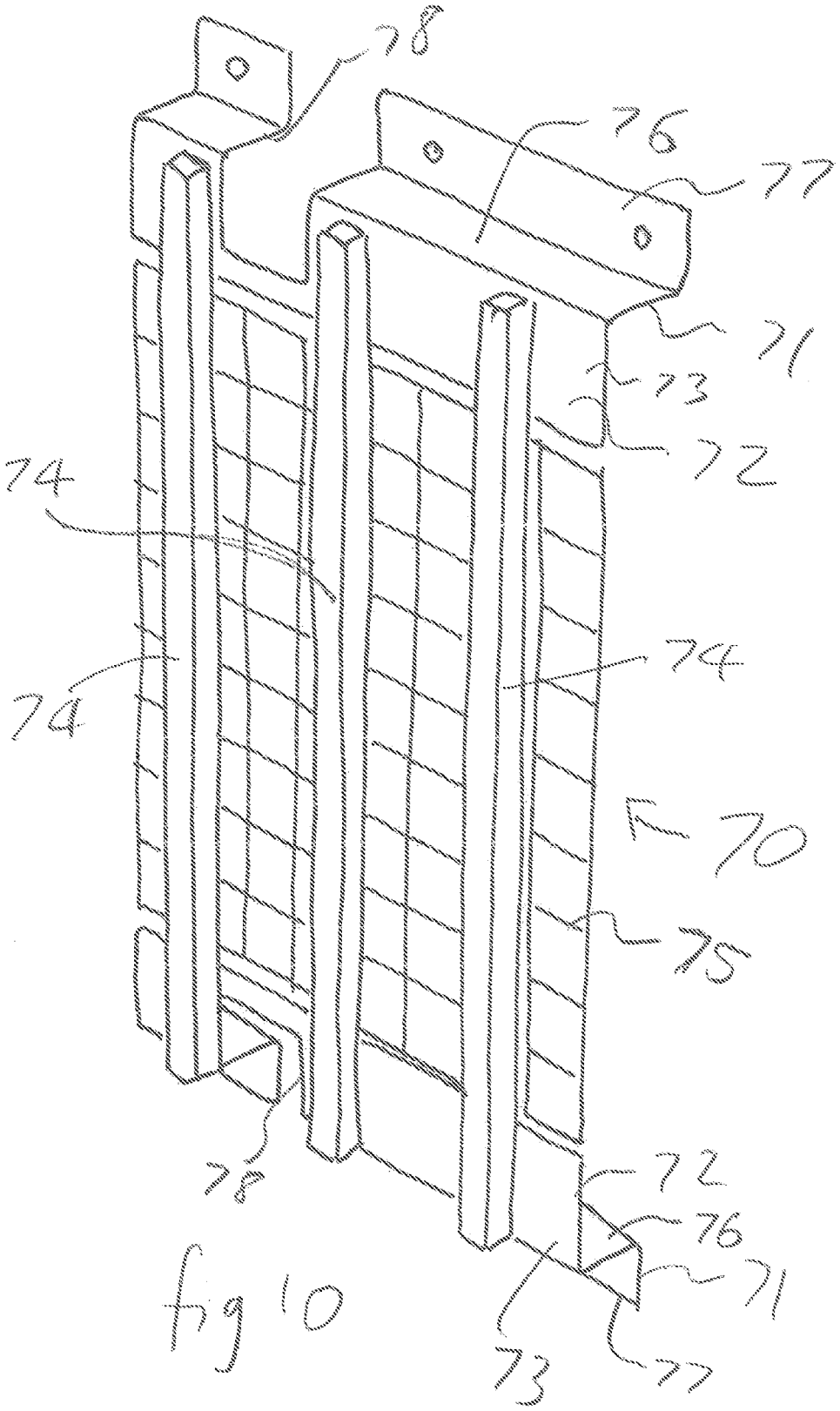
FIG. 10 shows a perspective view of a blocking device of a fifth embodiment of the invention.

With reference to FIGS. 9 and 10, as an alternative to the use of separate stand-off brackets 27, as shown in FIGS. 9 and 10, the blocking devices 60, 70 may be provided with integrated stand-off portions 61, 71 formed as part of the frames of the blocking devices. Thus the frame 61 of the blocking device 60 of the fourth embodiment of the invention shown in FIG. 9 has a frame member 62 which comprises a first frame portion 63, to which the bars 64 and mesh 65 is attached, a web 66 extending perpendicular to the first frame portion 63, from the end of the frame portion 64 proximal the mesh 65 and a second frame portion 67 extending from the web 66 parallel to the first frame portion 63 distal the mesh 75.

On the other hand, the frame 71 of the blocking device 70 of the fifth embodiment of the invention shown in FIG. 10 has a somewhat Z-shaped frame member 72 which comprises a first frame portion 73, to which bars 74 and mesh 75 is attached, a web 76 extending perpendicular to the first frame portion 73, from the end of the frame portion 74 distal the mesh 75 and a second frame portion 77 extending from the web 76 in a plane parallel to the first frame portion 73, extending away from the mesh 75.

Cutaways 78 can be seen in the frame members 72 of the blocking device 70, in order to allow easy access to window furniture, such as handles (not shown).

Figure 7:
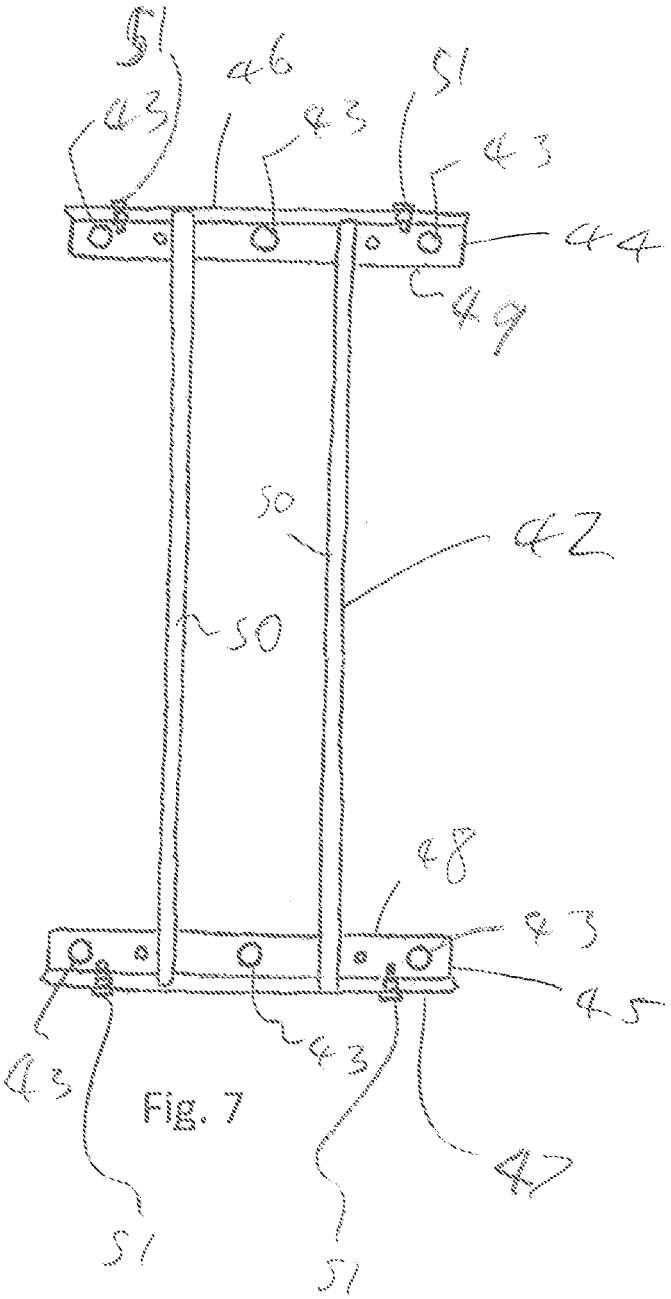
FIG. 7 shows a front plan view of a jig for installing an anti-piracy device.

In order to mount the mounts 16 for the blocking devices 10, 33, 37, 60. 70 to the correct positions on the interior walls of ships, a jig is used. FIG. 7 shows a jig for use in adhering the mounts 15 for the rectangular blocking devices 10, 33 in position.

The jig 42 comprises a frame formed by an upper laterally extending frame member 44 and a lower laterally extending frame member 54 each preferably formed of metal, e.g. steel plate of e.g. 3 mm thickness and 50 mm height. The frame members 44, 45 are formed in L-shapes, such that they also have a depth of e.g. 50 mm, with an upper surface 46 and a parallel lower surface 47, as well as two coplanar surfaces 48, 49.

A pair of bars 50 extend between the frame members 44, 45 to hold them in their relative positions, which replicate the distance between the frame members 11, 12 of the blocking device 10.

Each of the coplanar surfaces 48, 49 of the upper and lower frame members 44, 45, is provided with three apertures 43, spaced apart by the same distance from their centres as the apertures 43 in the upper and lower frames 1, 12 of the blocking device 10. However the apertures 43 of the jig 42 are larger than the apertures of the blocking device 10, corresponding in size to the diameter of the plates 17 of the mounts 16. Thus six apertures are provided which have the same relative positions as the six apertures (not shown) through which the mounts 16 extend in the blocking device 10.

The jig 42 is also provided with four height adjustable feet 51, two on each of the upper surface 46 and the lower surface 47 extending away from them.

Figure 8:
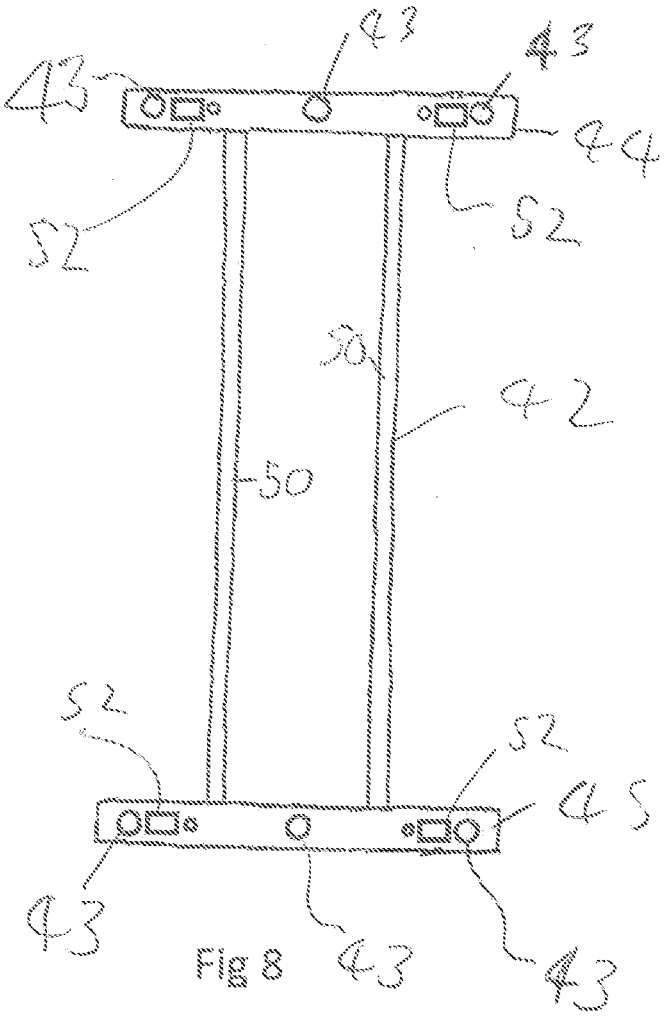
FIG. 8 shows a rear plan view of the jig of FIG. 7.

As shown in FIG. 8, four magnets 52 of defined thickness are also provided, either attached to, or for connection to the rear side of the upper and lower frame members 44, 45.

Those skilled in the art will readily conceive of the alternative shapes/sizes required for fitting different blocking devices.

In use, to provide a ship with the anti-piracy devices of the invention, a jig 42, is arranged in position on an interior wall, 1, of a ship, such as the window frame of a ship, and the central apertures 43 are lined up with the centre of the window frame, with the apertures adjacent to the opening (i.e. the window pane). If the magnets 52 are not permanently connected to the jig 42, this is done without the magnets 52 in place, so that the coplanar surfaces 44 45 are flush with the wall. The adjustable feet are then adjusted to come into contact with a window frame surround, and adjusted to level out the jig 42 relative to the window frame. If the wall does not have a window frame surround, the magnets can be attached to hold the jig in position.

The interior wall 1 is then marked out with the position of the apertures 43 (which as mentioned above correspond to the apertures (not shown) through which the mounts will extend. The jig 42 is then removed and surface of the interior wall is then prepared, by e.g. removing paint, abrading removing dirt/debris, cleaning and priming the area marked out behind each aperture 42.

Then adhesive is applied to the plates of each mount 16 and each mount is attached in position on the area marked out, by pushing the plate 17 against the wall, such that the 2 mm bed of adhesive and the adhesive rivets 20 are formed.

In an alternative embodiment, the jig 42 may be provided with apertures of the same size as the threaded rods 18. Thus, once the area for receiving the mounts 16 has been marked out, abraded and primed, the mounts can be removably fastened through the apertures in the jig 42, adhesive can be applied, and then, if the magnets 52 are not permanently connected to the jig 42, they are connected the interior wall and the jig can be connected to the wall via the magnets 52, spaced from the wall by the magnets 52 by a suitable amount to effect the correct thickness of adhesive bed 20 with sufficient adhesive being pushed through the apertures in the plate to form the adhesive rivets.

Once the adhesive has set, the mounts 16 can be unfastened from the jig 42 and the jig 42 can be removed, leaving the mounts 16 permanently attached to the interior of the ship, adjacent to the opening and perfectly placed to mate with the apertures in the frame of the blocking device 10.

Then, the blocking device 10 can be removably attached to the mounts, by fitting the mounts threaded rods 18 of the mounts 16 through corresponding apertures (not shown) in the frame of the blocking device 10 and removably fastening the blocking device to the mounts with fasteners in the form of bolts 15.

Figure 4:
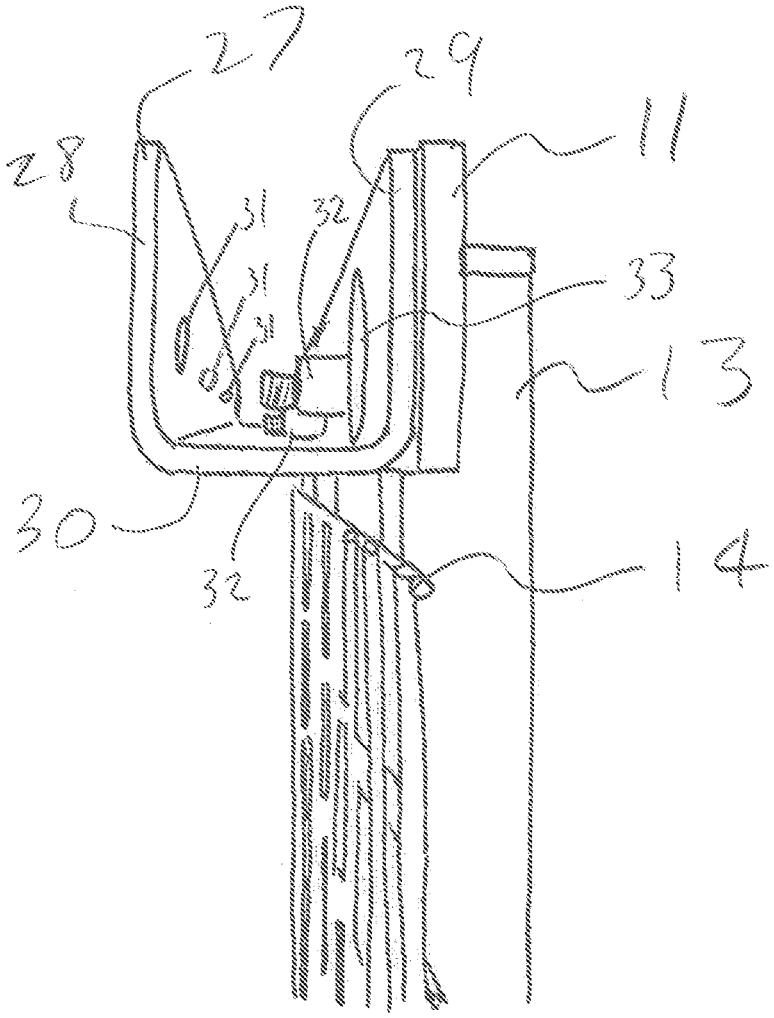
FIG. 4 shows a perspective view of a stand-off bracket attached to the blocking device of FIG. 1.

In the event that door furniture, or the like is in the way, the stand-off bracket 27 of FIG. 4 can be attached to the interior wall 1 by means of the mounts 16 in a similar fashion.

For added security, the aperture 25 of anti-tamper brackets 21 can be aligned with one or more of the apertures and the mounts 16 and can be attached between the fastener 15 and the blocking device 10 to make removal of the blocking device from outside the ship, even more difficult.

The blocking device 10 of the anti-piracy device can then be removed during travel through safe waters, by simply unfastening the fasteners 15, in order to avoid the interior of the ship feeling like a prison, and then reattached when entering dangerous waters.

The same process, with a different jig, is used to adapting a ship for receiving the porthole blocking plate 37 of FIG. 6, whilst the blocking devices 33, 60, 70 of FIGS. 5, 9 and 10 could be used interchangeably with the blocking device 10 of FIG. 1.

The above embodiments are described by way of example only. Many variations are possible without departing from the spirit and scope of the invention as defined in the appended claims.

The invention claimed is:

1. An anti-piracy device comprising a blocking device, for blocking a space behind an opening to the interior of the ship, a plurality of mounts for permanent attachment to the interior of a ship adjacent the opening, and a plurality of fasteners for removably attaching the blocking device to the mounts, wherein the blocking device is formed of metal.

2. An anti-piracy device according to claim 1 wherein the mounts and the fastener are provided with screw threads, so that the fastener can be unscrewed to remove the blocking device when in safe waters.

3. An anti-piracy device according to claim 1 wherein the mounts are adhered to the interior of the ship.

4. An anti-piracy device according to claim 1 further comprising at least one stand-off bracket mounted to the mounts, whereby in use, the blocking device is mounted to the mounts via the stand-off bracket.

5. An anti-piracy device according to claim 1 further comprising one or more anti-tamper brackets provided between the fastener and the blocking device.

6. An anti-piracy device according to claim 1 wherein the opening closed by the blocking device is a window or porthole and the blocking device is located to the interior of the window or the porthole.

7. An anti-piracy device according to claim 1 wherein the blocking device is a solid plate, which extends entirely across the opening.

8. An anti-piracy device according to claim 1 comprising a grille having a frame for mounting to the mounts and bars extending from the frame or a plate having apertures therein so as to form a grid pattern.

9. An anti-piracy device according to claim 8 where the frame has a plurality of apertures therein to receive threaded rods of the mount.

10. A ship having an interior and an exterior, with an opening from the exterior to the interior and at least one mount provided on the interior adjacent the opening, wherein, in use, an anti-piracy blocking device is removably attached to the at least one mount to prevent or slow down access by pirates to the interior of the ship through the opening, the anti-piracy blocking device comprising a grille having a frame for mounting to the at least one mount and at least one bar extending from the frame or a plate having apertures therein so as to form a grid pattern.

11. A ship according to claim 10 wherein the at least one mount is adhered to an interior wall of the ship, inward of the opening.

12. A ship according to claim 10 wherein the opening is a window or porthole having a pane of glass therein, the blocking device providing a secondary line of defense behind the pane of glass.

13. A ship according to claim 11 having at least one porthole and at least one window, wherein at least one mount is provided adjacent the porthole and at least one mount is provided adjacent the porthole and wherein a blocking device comprising a grille is removably attached to the mounts adjacent the window to the interior thereof and a blocking device comprising a solid plate is mounted adjacent the porthole, to the interior thereof.

14. A method of adapting a ship for improving the likely outcome in the event of pirate attack, the method comprising fixing mounts to an interior wall of the ship adjacent an opening and providing a blocking device and fasteners, whereby the blocking device can be removably fastened to the mounts to block the opening, wherein the mounts comprise plates having apertures therein and threaded rods extending from the plates, wherein the mounts are attached to the interior wall by adhesive, by pushing the plate of the mount into the adhesive until the threaded rods extend through the apertures in the plate and forms heads to the interior of the plate, the method further comprising using a jig to identify where to adhere the mounts and marking up the interior wall accordingly.

15. A method according to claim 14 comprising providing magnets on one side of the jig to locate it on the interior wall of the ship and space the jig from the wall.

16. A method according to claim 15 further comprising fitting the mounts to the jig and fastening them thereto to provide a gap between the mounts and the interior wall, when the magnets are flush with the wall, then providing adhesive on the plate of the mount, then returning the jig to its position on the interior wall and pushing the mounts against the wall to adhere them to the wall in position.

17. A method according to claim 16 further comprising removably attaching the blocking device to the interior of the ship, by inserting threaded rods through apertures in the blocking device and screwing nuts onto the bolts to hold the blocking device in place.

18. The method according to claim 17 further comprising fitting an anti-tamper bracket between the blocking device and the nuts.

19. The ship according to claim 10 wherein the blocking device is formed of metal.

20. The method of claim 14 wherein the blocking device is formed of metal.

21. The anti-piracy device of claim 1 wherein said blocking device consists of metal.

* * * * *